US005987723A

United States Patent [19]

McNally et al.

[11] Patent Number: 5,987,723

[45] Date of Patent: Nov. 23, 1999

[54] APPARATUS AND METHOD FOR RAPID, REMOTE, FORCIBLE ENTRY

[76] Inventors: Daniel L. McNally, 2601 Henry Hudson Pkwy., Bx., N.Y. 10463; Peter A. Scoolidge, 32 Wilson Rd., Sparrow Bush, N.Y. 12780

[21] Appl. No.: 08/782,319

[22] Filed: Jan. 15, 1997

[51] Int. Cl.[6] ..... B25F 5/00

[52] U.S. Cl. ..... 29/254; 83/30; 86/50; 173/141; 29/254

[58] Field of Search ..... 227/9, 10; 29/254; 7/144; 173/144, 141; 83/30, 39; 86/50; 89/1.4; 254/93 R, 11

[56] References Cited

U.S. PATENT DOCUMENTS

| | | | |
|---|---|---|---|
| 2,483,239 | 9/1949 | Sharpe | 254/93 R X |
| 2,526,148 | 10/1950 | McLean | 254/93 R |
| 3,370,421 | 2/1968 | Piper | 254/93 R X |
| 3,594,890 | 7/1971 | Cordell | 29/255 |
| 3,710,655 | 1/1973 | Brandle | 81/52.35 |
| 4,054,032 | 10/1977 | Patrichi | 29/254 X |
| 4,201,368 | 5/1980 | Vetter | 254/131 |
| 4,268,926 | 5/1981 | Roxton | 7/143 |
| 4,270,733 | 6/1981 | DePue | 254/93 R |
| 4,660,806 | 4/1987 | Masters | 254/93 R X |
| 4,681,171 | 7/1987 | Kee et al. | 173/90 |
| 4,783,053 | 11/1988 | Yirmiyahu et al. | 254/93 R |
| 5,088,174 | 2/1992 | Hull et al. | 29/254 |
| 5,167,043 | 12/1992 | Lopez et al. | 7/144 |
| 5,177,850 | 1/1993 | Hull et al. | 29/254 |
| 5,237,613 | 8/1993 | Berry et al. | 29/254 X |
| 5,329,685 | 7/1994 | Gillespie | 29/254 |
| 5,386,758 | 2/1995 | Conley | 86/50 |
| 5,423,469 | 6/1995 | Armstrong | 227/9 |
| 5,657,676 | 8/1997 | Koller | 83/30 |
| 5,673,898 | 10/1997 | Michalo | 29/254 X |

*Primary Examiner*—Rinaldi I. Rada
*Assistant Examiner*—Charles Goodman
*Attorney, Agent, or Firm*—Roderick S.W. Turner

[57] ABSTRACT

An apparatus (10) for the rapid, remote, forcible entry of the trunk lid or cargo area of a vehicle which includes one or more heads (12) engaged under the trunk lid or against the external wall of the vehicle to be breached, a piston rod (14) attached to one or more of the heads (12), a piston rod collar (16) through which the piston rod (14) slides, a piston (20) attached to the remaining end of the piston rod (14), a cylinder (22) within which the piston (20) is disposed and freely slides, a firing chamber (24) positioned on the external surface of the cylinder (22) enclosing an explosive means (24D) which provides the force with which the apparatus breaches the vehicle, a foot (28) attached to the cylinder (22) which serves as a tractional base for the apparatus (10), and a means for detonation connected to the explosive means (24D).

15 Claims, 4 Drawing Sheets

APPARATUS AND METHOD FOR RAPID, REMOTE, FORCIBLE ENTRY

The following invention and application relates to the Disclosure Document No. 388554 previously filed in the Patent and Trademark Office on Jun. 30, 1995. It is requested that this Disclosure Document be retained and referenced to the following invention and application.

BACKGROUND—FIELD OF THE INVENTION

This invention relates to devices and methods for forcible entry, and more particularly to a device and method used by law enforcement personnel to open the trunk of vehicles, and cut observation/entry portals through the sides of vans and trucks suspected of containing explosives from a safe distance.

BACKGROUND—DISCUSSION OF THE PRIOR ART

The safe entry into vehicles suspected of containing explosives has long been a problem for law enforcement agencies. The increasing prevalence of explosive devices which detonate upon the slightest disturbance underscores the demand for a safe, remote, effective, and economical apparatus and method to enter a vehicle without disturbing the contents of that vehicle.

In the past various methods to forcibly enter the trunk of vehicles or cargo area of vans or trucks have been employed including the use of explosives, auxiliary powered metal cutting tools, and sophisticated burning devices. However, each of these methods has had inherent problems such as the creation of excessive damage to the vehicle, unreasonable delays in gaining entry, and fire hazards. The expense associated with successive applications of these methods has also become a significant factor in rendering many of the prior art methods impractical.

Therefore, there is a need for a rapid, remote, forcible entry tool which is comparatively non-destructive, fast, and inexpensive to apply that will not create unreasonable fire hazards.

Hand held forcible entry tools and other variations of the ancient battering ram have been well documented in the prior art (U.S. Pat. No. 5,177,850 of Hull et al. and U.S. Pat No. 5,167,043 of Lopez et al.). One problem in using such tools to open the trunk of a vehicle suspected of containing a bomb which may detonate upon entry is the unavoidable risk of great physical harm to the operator. When a heavily fortified door is breached by one of the forcible entry tools taught in the prior art the operator is ordinarily given a reasonable opportunity to avoid danger by strategic body positioning prior to entry. This is to be distinguished from the situation where law enforcement personnel must gain entry into the trunk or cargo area of a vehicle which may detonate instantly upon the slightest disturbance. In this case the operator does not have the luxury of stepping out of harm's way. If the operator is close enough to use a forcible entry tool in the prior art he is necessarily too close to safely retreat. In addition, many of the forcible entry tools in the prior art consist of open joints which move relative to each other and are not covered or protected. The operator may be exposed to such parts which are intended to collide with great force during normal operation of the tool. If an operator's finger or hand is in the wrong place at the time of this collision, the result may be disastrous. Since such tools are often used in emergency situations where time is of the essence, and the operator is concentrating on other factors, the operator should not be called upon to divert his attention to the operation of the very tool he is using to avert further harm.

Therefore, there is a need for a rapid, remote, forcible entry tool which may be remotely operated from a safe distance in order to grant the greatest degree of safety to the operator, particularly in an emergency situation where the operator may not be concentrating solely on the operation of the tool.

In a great many circumstances law enforcement personnel find it extremely advantageous and even absolutely necessary to do as little damage as possible to the contents of the trunk or cargo area of a vehicle. Such is the case when evidence must be recovered in a condition suitable for presentation at trial or when an individual is trapped within the trunk.

Therefore, there is a need for a rapid, remote, forcible entry tool which may be operated in the least destructive way possible with respect to the contents of the trunk of the vehicle.

Often law enforcement personnel find themselves relatively unsure of the contents of a vehicle and as a consequence unsure of whether to destroy the body of the vehicle in attempting a forcible entry. Many of the methods employed in the prior art such as those using auxiliary powered cutting tools and burning devices result in unnecessary yet unavoidable damage to the bodily integrity of the vehicle. This becomes particularly unfortunate if nothing of interest is found in the trunk or cargo area. To understand the ability of a forcible entry tool to cause the least amount of damage to a vehicle one must investigate the physics involved in breaking into the trunk or cargo area of the vehicle. The head of the forcible entry tool has a mass which is accelerated upon impact with the trunk lid. The kinetic energy of the moving mass is applied to the trunk lid as the head of the forcible entry tool moves the trunk lid away from its normal resting position. The kinetic energy is not applied instantaneously but rather as the head of the forcible entry tool comes to a stop over a finite distance and time. Since force is the product of mass times acceleration and acceleration is the rate of change of velocity, the velocity of the head of the forcible entry tool in part determines the resulting force on the trunk lid. To bring the total force available to bear on the trunk lid or walls of the cargo area in as short a time as possible requires a higher striking velocity which will result in a higher peak force. As the peak force is increased so too is the ability of the tool to break the trunk lid in a localized area around the latch thereby restricting the physical extent of the damage to the integrity of the body of the vehicle. The present invention may also be used to cut an observation portal through the sides of a van or truck in order to gain access to the cargo area.

Therefore, there is a need for a rapid, remote, forcible entry tool which may be operated in the least destructive way possible with respect to the integrity of the body of the vehicle.

Some of the forcible entry tools in the prior art consist of open joints and areas in which dirt or other jamming substances may be deposited. When the tool is used or stored in a dusty environment, these particles may become lodged between tool parts that are intended to move freely with an absolute minimum of friction. The result is damage to the tool, unreliable operation, and the potential for risk of harm to the operator.

Therefore, there is a need for a rapid, remote, forcible entry tool which is not susceptible to damage or jamming by dirt, dust, moisture or other particles found in the environment.

Many of the battering rams found in the prior art are intended for use on upright vertical doors through either a direct forward exertion of force for doors which open away from the operator or a pulling force exerted on hooks embedded into doors which open towards the operator. The first of these methods is not practical for breaching the trunk lid of a vehicle since the trunk lid effectively opens towards the operator. The latter method is likewise not a practical approach since it would potentially result in far greater damage to both the integrity of the body of the vehicle and the contents of the trunk or cargo area of a vehicle. It is also not practical to swing an ordinary battering ram in such a way as to breach the trunk of a vehicle or the cargo area of a van or truck.

Therefore, there is a need for a rapid, remote, forcible entry tool which is specifically intended to gain access into the trunks of vehicles and the cargo area of vans and trucks.

At least one of the forcible entry tools in the prior art (U.S. Pat. No. 5,329,685 of Gillespie) teaches the use of compressed gas as a means of providing the force to breach a door. While compressed gas may be effective it is limited in the following respects:

1. the peak force which may be generated;
2. the increased size and weight of the operable tool including a supply of compressed gas;
3. the cost per application; and
4. the safety hazards in transporting compressed gas.

Therefore, there is a need for a rapid, remote, forcible entry tool which derives the force required to breach the trunk or cargo area of a vehicle from a medium which is smaller, lighter, cheaper, safer and more potentially more powerful than compressed gas.

At least one of the forcible entry tools in the prior art (U.S. Pat. No. 5,177,850 of Hull et al.) teaches the use of ganged tools to achieve a greater amount of force. While this method of increasing force is certainly available it may become unnecessarily cumbersome.

Therefore, there is a need for a rapid, remote, forcible entry tool which derives force from a medium which is readily adjustable in strength without requiring a greater number of tools.

Many known forcible entry tools which are applicable to vehicle doors are not adaptable to the wide variety of body contours that exist between different vehicles. The effectiveness of the entry process may be inhibited because a forcible entry tool is not sufficiently adjustable to the intended application and cannot reasonably be made so.

Therefore, there is a need for a rapid, remote, forcible entry tool which is readily adaptable to the wide variety of vehicle contours in existence whether envisioned by the manufacturer at the time the tool is initially produced or not.

The present invention addresses the aforementioned problems encountered by law enforcement personnel which the prior art has not addressed in an effective and satisfactory manner.

OBJECTS AND ADVANTAGES OF THE INVENTION

Accordingly, several objects and advantages of the present invention are:

(a) to provide a rapid, remote, forcible entry tool which is fast, inexpensive to apply and will not create unreasonable fire hazards;

(b) to provide a rapid, remote, forcible entry tool which may be remotely operated from a safe distance in order to grant the greatest degree of safety to the operator, particularly in an emergency situation where the operator may not be concentrating solely on the operation of the tool;

(c) to provide a rapid, remote, forcible entry tool which may be operated in the least destructive way possible with respect to the contents of the trunk of the vehicle;

(d) to provide a rapid, remote, forcible entry tool which may be operated in the least destructive way possible with respect to the integrity of the body of the vehicle;

(e) to provide a rapid, remote, forcible entry tool which is not susceptible to damage or jamming by dirt, dust, moisture or other particles found in the environment;

(f) to provide a rapid, remote, forcible entry tool which is specifically intended for use on the trunk lid of vehicles;

(g) to provide a rapid, remote, forcible entry tool which derives force from a medium which is smaller, lighter, cheaper, safer and potentially more powerful than compressed gas;

(h) to provide a rapid, remote, forcible entry tool which derives the force required to breach the trunk lid and cargo area of a vehicle from a medium which is readily adjustable in strength without requiring a greater number of tools; and (i) to provide a rapid, remote, forcible entry tool which is readily adaptable to the wide variety of vehicle trunk lid contours in existence whether envisioned by the manufacturer at the time the tool is initially produced or not.

Further objects and advantages of the present invention will become apparent from consideration of the ensuing drawing and description.

BRIEF DESCRIPTION OF THE DRAWING FIGURES

In the drawings, closely related elements have the same number but different alphabetic suffixes.

REFERENCE NUMERALS IN THE DRAWING FIGURES

Figure 1:
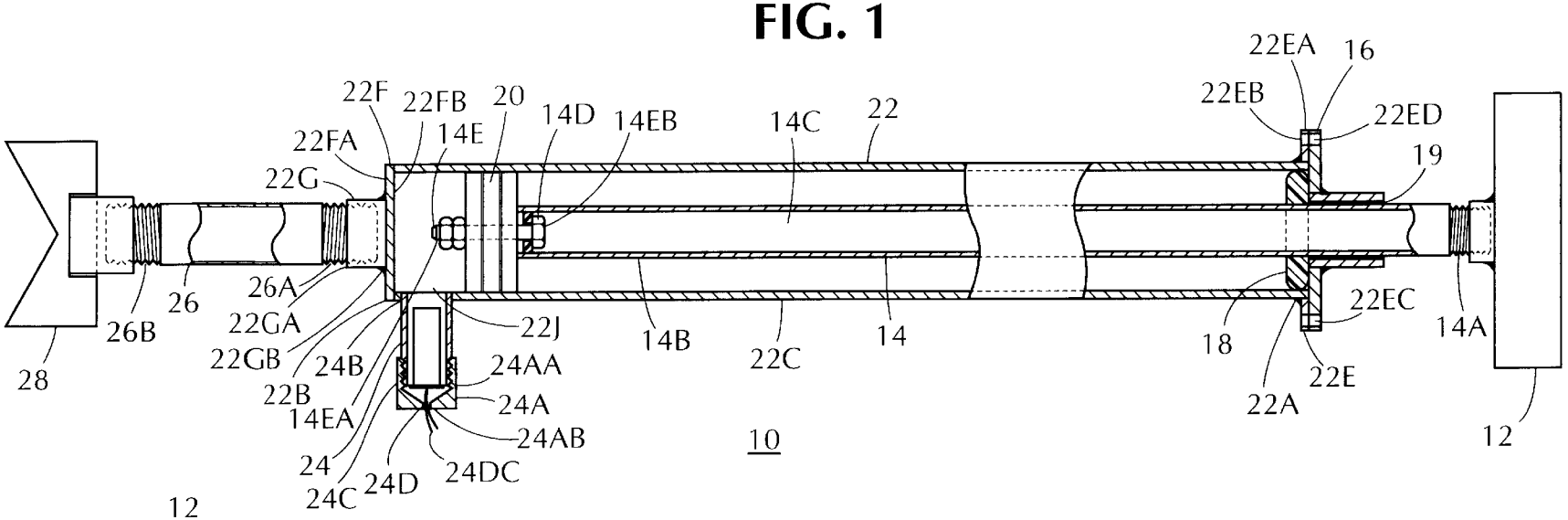
FIG. 1 shows a side cut-away view of the preferred embodiment of the rapid, remote, forcible entry device of the present invention in a compressed position prior to use.

10 rapid, remote, forcible entry device
12 head
12A catch
  12AA external surface
  12AB troughlike internal surface
12B pipe coupling
  12BA lower end
  12BB upper end
14 piston rod
14A head end
14B piston end
14C internal surface
14D piston rod stud nut
14E piston rod stud
  14EA piston section
  14EB piston rod section
16 piston rod collar
16A lower end
16B upper end
16C piston rod collar ring
  16CA lower surface
  16CB upper surface
  16CC external circumference
  16CD holes
18 piston buffer
19 bushing
20 piston
20A lower surface
20B upper surface
20C external circumference
20D hole
20E central longitudinal axis
20F lower groove
20G lower piston ring
20H upper groove
20I upper piston ring
20J piston nut
20K washer
22 cylinder
22A upper end
22B lower end
22C external surface
22E cylinder ring
  22EA external circumference
  22EB lower side
  22EC upper side
  22ED holes
22F cylinder plate
  22FA lower surface
  22FB upper surface
22G cylinder pipe collar
  22GA lower surface
  22GB upper surface
22J firing hole
24 firing chamber
24A firing chamber end cap
  24AA circular outside surface
  24AB hole
24B cylinder end
24C cap end
24D explosive means
  24DA ignition end
  24DB explosive end
  24DC ignition wires
  24DD wad
  24DE booster
  24DF hot glue
  24DG squib
  24DH charge
  24DI hull
26 extension leg
26A upper end
26B lower end
28 foot
28A foot pipe
  28AA upper end
  28AB lower end
  28AC longitudinal axis
  28AD slot
28B foot plate
  28BA tab
  28BB central edges
  28BC external points
  28BD external edges
  28BE central point

DESCRIPTION OF THE INVENTION

The preferred embodiment for the rapid, remote, forcible entry device 10 of the present invention is illustrated in FIG. 1. The rapid, remote, forcible entry device 10 includes a head 12, a piston rod 14, a piston rod collar 16, a piston buffer 18, a piston 20, a cylinder 22, a firing chamber 24, an extension leg 26, a foot 28, and a means for detonation.

Figure 3B:
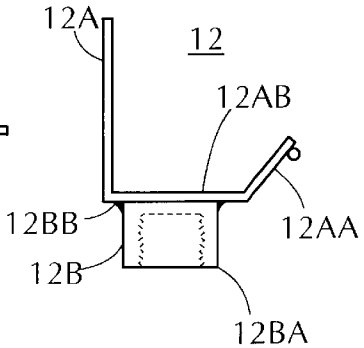
FIG. 3 shows a side view of another embodiment of the head of the preferred embodiment of the rapid, remote, forcible entry device which may be used to cut observation/entry portals through the sides of vans and trucks.
Figure 3A:
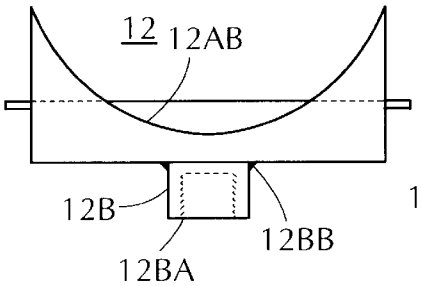
Figure 2C:
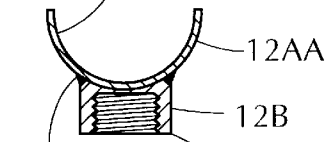
FIG. 2 shows a side view of the head of the preferred embodiment of the rapid, remote, forcible entry device.
Figure 2B:
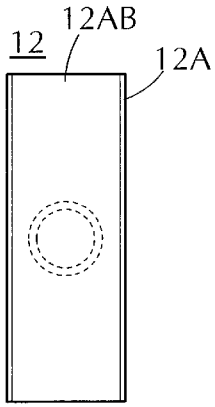
Figure 2A:
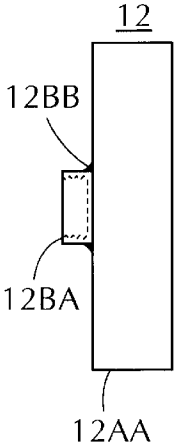
Figure 12B:
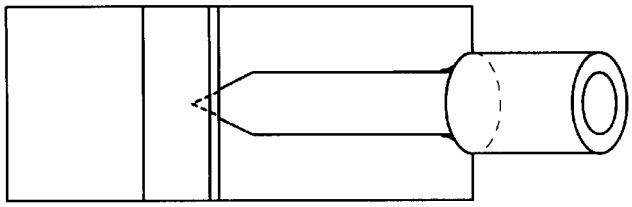
FIG. 12 shows a detailed side and top view of a head designed to breach doors (third embodiment).
Figure 12A:
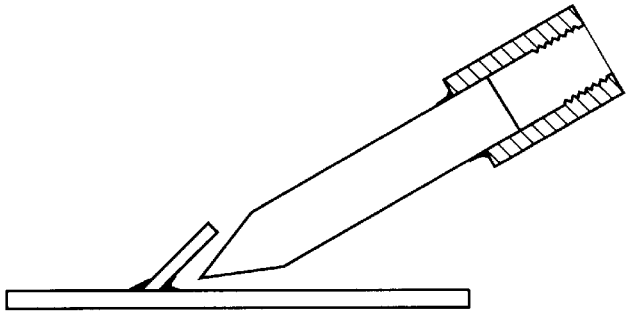
Figure 10B:
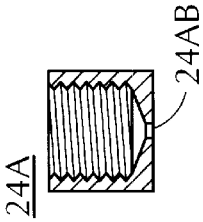
FIG. 10 shows a detailed top and cross-sectional view of the firing chamber end cap.
Figure 11B:
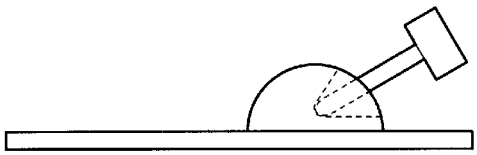
FIG. 11 shows a detailed side and top view of a head designed to breach residential doors (second embodiment).
Figure 10A:
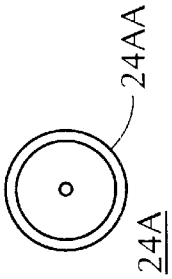
Figure 11A:
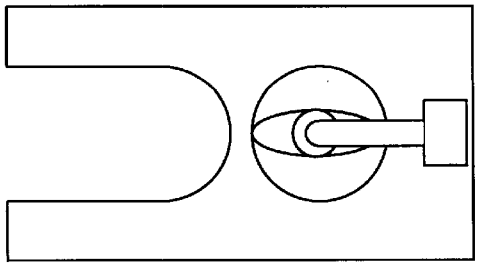

The head 12, as illustrated in FIG. 2 and FIG. 3, consists of a catch 12A and a pipe coupling 12B. The catch 12A has an external surface 12AA, a troughlike internal surface 12AB, and is constructed from stainless steel approximately one quarter inch (¼") in thickness. The troughlike internal surface may be of various shapes and dimensions best suited to mirror the contours of the trunk lid of the vehicle. The catch and pipe coupling may be manufactured with various dimensions, contours, and angles of attachment and used as interchangeable units to be fitted to the apparatus for the rapid, remote, forcible entry of the trunk lid of a vehicle as the particular application demands. The pipe coupling 12B has a lower end 12BA, an upper end 12BB, and is constructed from an approximately one inch (1") outside diameter schedule 40 stainless steel pipe coupling with standard internal threads. The upper end 12BB of the pipe coupling 12B is welded perpendicularly to the external surface 12AA of the catch 12A. Additional embodiments of the head 12 are shown in FIGS. 11 and 12.

The piston rod 14, as illustrated in FIG. 1, has a head end 14A, a piston end 14B, an internal surface 14C, and is approximately eighteen inches (18") in length. The piston rod 14 is constructed from schedule 80 stainless steel pipe with an outside diameter of approximately one inch (1").

The head end 14A of the piston rod 14 has standard external threads which mate to and are screwed into the standard internal threads of the lower end 12BA of the pipe coupling 12B of the head 12. The piston rod 14 has a piston rod stud nut 14D with an inside diameter of approximately one half inch (½"), standard internal threads and which is welded to the internal surface 14C at the piston end 14B of the piston rod 14. The piston rod 14 also has a piston rod stud 14E which consists of a piston section 14EA, a piston rod section 14EB, and standard external threads running the entire length of the piston rod stud 14E which mate to and are screwed into the piston rod stud nuts 14D at the piston rod section 14EB of the piston rod stud 14E. The length of piston rod stud 14E is approximately three and one half of an inch (3½") and is manufactured from grade 8 (hardness) steel.

Figure 4B:
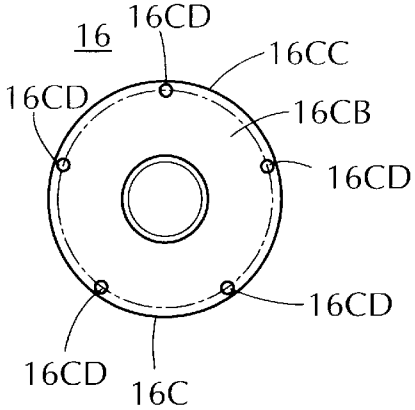
FIG. 4 shows a side and a top view of the piston rod collar of the preferred embodiment of the rapid, remote, forcible entry device showing also the handle.
Figure 4A:
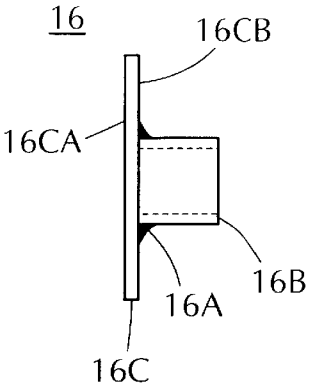

The piston rod collar 16, as illustrated in FIG. 4, is approximately one and one half of an inch (1½") in outside diameter, approximately two inches (2") in length, and is constructed from schedule 40 stainless steel pipe. The piston rod collar 16 has a lower end 16A, an upper end 16B, and a piston rod collar ring 16C. The piston rod collar ring 16C has a lower surface 16CA, an upper surface 16CB, an external circumference 16CC, an outside diameter of approximately five inches (5"), an inside diameter of approximately two inches (2"), and a thickness of approximately three eighths of an inch (⅜"). The upper surface 16CB of the piston rod collar ring 16C is welded to the lower end 16A of the piston rod collar 16. The piston rod collar ring 16C has a plurality of holes 16CD each of which is drilled with a diameter which will accept an approximately one quarter inch (¼") stainless steel bolt. The holes 16CD are spaced equidistant from each of the other holes 16CD along the upper surface 16CB of the piston rod collar ring 16C. The center of each of the holes 16CD is spaced approximately one half of an inch (½") radially inward from the external circumference 16CC of the cylinder ring 16C. The piston rod collar 16 contains a bushing 19 which has an inside diameter of approximately one and one quarter of an inch (1¼"), an outside diameter of approximately one and one half of an inch (1½"), and a thickness of approximately one eighth of an inch (⅛"). The bushing 19 is press fitted into place within the piston rod collar 16. The piston end 14B of the piston rod 14 with the piston rod stud 14F is slid through the bushing 19 within the piston rod collar 16 and piston rod collar ring 16C starting from the upper end 16B of the piston rod collar 16 and proceeding through and out the lower surface 16CA of the piston rod collar ring 16C. The bushing 19 functions as a wear resistant guide for the piston rod 14 as the piston rod 14 slides through the piston rod collar 16 and piston rod collar ring 16C.

The piston buffer 18, as illustrated in FIG. 1, is a donut constructed from rubber or other shock-absorbent substance which has an outside diameter of approximately three inches (3"), an inside diameter of approximately one and three quarters of an inch (1¾"), and a thickness of approximately one and one half of an inch (1½"). The piston end 14B of the piston rod 14 which protrudes from the lower surface 16CA of the piston rod collar ring 16C is slid through and out the piston buffer 18.

Figure 5B:
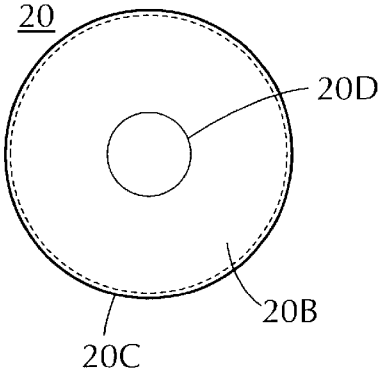
FIG. 5 shows a side and a top view of the piston of the preferred embodiment of the rapid, remote, forcible entry device.
Figure 5A:
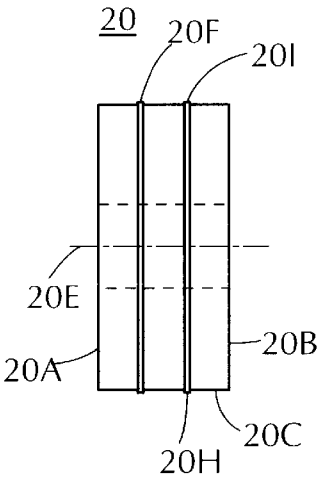
Figure 6:
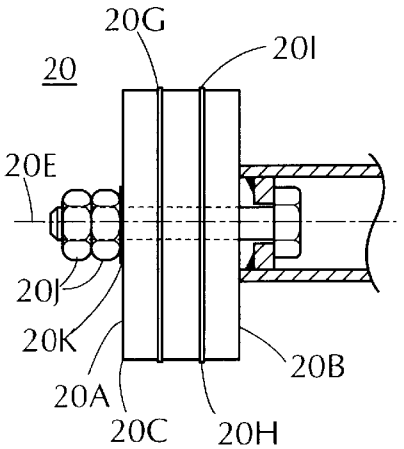
FIG. 6 shows a side view of the piston of the preferred embodiment of the rapid, remote, forcible entry device as it is attached to the piston rod.
Figure 9A:
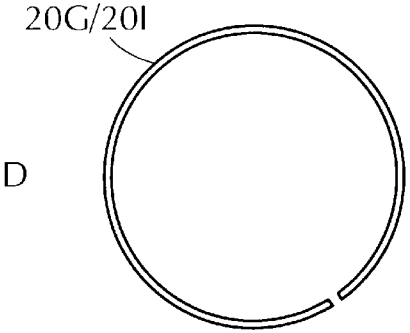
FIG. 9 shows a detailed top and side view of the piston ring.
Figure 9B:
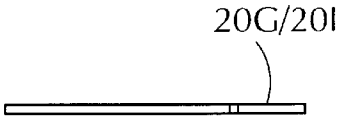
Figure 8:
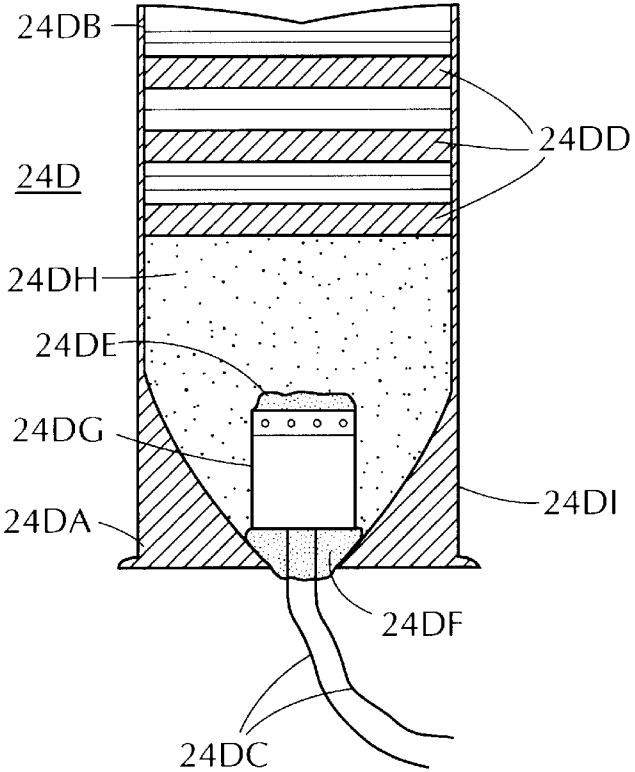
FIG. 8 shows a detailed cross-sectional view of the explosive means of the preferred embodiment of the rapid, remote, forcible entry device.

The piston 20, as illustrated in FIG. 5 and FIG. 6, is cylindrical with a lower surface 20A, an upper surface 20B, and an external circumference 20C. The piston 20 is approximately one and one half of an inch (1½") in height with an outside diameter of approximately three inches (3") and a hole 20D with a diameter of approximately one half of an inch (½") drilled through the central longitudinal axis 20E of the piston 20 perpendicular to the upper surface 20B of the piston 20. The piston 20 is constructed from solid aluminum. The piston 20 has a lower groove 20F cut into the external circumference 20C of the piston 20 approximately one inch (1") from the lower surface 20A of the piston 20 to accept a lower piston ring 20G which has a thickness of approximately one quarter of an inch (¼"). The piston 20 also has an upper groove 20H cut into the external circumference 20C of the piston 20 approximately one inch (1") from the upper surface 20B of the piston 20 to accept an upper piston ring 20I which has a thickness of approximately one quarter of an inch (¼"). Both the lower piston ring 20G and the upper piston ring 20I have the dimensions of standard automobile piston rings and are constructed from iron or chrome molybdenum. The piston section 14EA of the piston rod stud 14E is slid through the hole 20D of the piston 20 starting from the upper surface 20B of the piston 20 and continuing through and protruding from the lower surface 20A of the piston 20. The piston 20 has a washer 20K which is placed over the piston section 14EA of the piston rod stud 14E which protrudes from the lower surface 20A of the piston 20, and a piston nut 20J which is screwed onto the piston section 14EA of the piston rod stud 14E over the washer 20K thereby securing the piston 20 to the piston rod 14.

The cylinder 22, as illustrated in FIG. 1, has an upper end 22A, a lower end 22B, an external surface 22C, and is constructed from schedule 40 stainless steel pipe with an outside diameter of approximately four inches (4"), an inside diameter of approximately three and three eighths of an inch (3⅜") and a length of approximately eighteen inches (18"). The cylinder 22 has a firing hole 22J which is circular and approximately one and one quarter of an inch (1¼") in diameter located on the external surface 22C of the cylinder 22 set back approximately one and a quarter inches (1¼") from the lower end 22B of the cylinder 22. The cylinder 22 has a cylinder ring 22E with an external circumference 22EA, a lower side 22EB, an upper side 22EC, an outside diameter of approximately five inches (5"), an inside diameter of approximately three inches (3"), and a thickness of approximately three eighths of an inch (⅜"). The lower side 22EB of the cylinder ring 22E is welded onto the upper end 22A of the cylinder 22. The cylinder ring 22E is constructed from 316 stainless steel (Rockwell hardness designation). The cylinder ring 22E has a plurality of holes 22ED (typically five (5)) each of which is drilled to a diameter suitable to accept a one quarter inch (¼") stainless steel bolt and spaced equidistant from each of the other holes 22ED along the external circumference 22EA of the cylinder ring 22E, the center of each of the holes 22ED is spaced approximately one half of an inch (½") radially inward from the external circumference 22EA of the cylinder ring 22E. The cylinder 22 has a cylinder plate 22F with a lower surface 22FA, and an upper surface 22FB. The upper surface 22FB of the cylinder plate 22F is welded onto the lower end 22B of the cylinder 22 such that the lower end 22B of the cylinder 22 is entirely enclosed. The cylinder 22 has a cylinder pipe collar 22G with a lower end 22GA, an upper end 22GB, and an opening at the lower end 22GA which accepts an approximately one inch (1") outside diameter schedule 80 stainless steel pipe. The upper end 22GB of the cylinder pipe collar 22G is welded to the center of the lower surface 22FA of the cylinder plate 22F. The lower end 16CA of the piston rod collar ring 16C and the upper side 22EC of the cylinder ring 22E are placed together such that the holes 16CD of the piston rod collar ring 16C and the holes 22ED of the cylinder ring 22E are brought into alignment thereby enabling one quarter inch (¼") bolts constructed of stainless steel to be slid into the holes 16CD of the piston rod collar ring 16C, out the holes 22ED of the cylinder ring 22E, and screwed into one quarter inch (¼") nuts thereby fixing the piston 20 slidably within the cylinder 22.

The firing chamber 24, as illustrated in FIG. 1, is constructed from schedule 40 stainless steel pipe which is approximately three inches (3") in length, and approximately one and one quarter of an inch (1¼") in outside diameter. The firing chamber 24 has a firing chamber end cap 24A, a cylinder end 24B, and a cap end 24C. The cylinder end 24B of the firing chamber 24 is welded over the firing hole 22J of the cylinder 22 located on the external surface 22C of the cylinder 22. An explosive means 24D has an ignition end 24DA, an explosive end 24DB, and ignition wires 24DC which protrude from the ignition end 24DA of the explosive means 24D. The explosive means 24D, as illustrated in FIG. 1 is essentially a modified shotgun shell with a standard crimp on a twelve (12) gauge hull 24DI and a twelve (12) gauge wad 24DD without a shotcup. The explosive means 24D typically has a charge 24DH which consists of three (3.0) grams of Red Dot powder and one and one half (2½) of a gram of FFFG mixed powder. The ignition wires 24DC are inserted through the hull 24DI into a squib 24DG and the FFFG booster 24DE which is kept in place within the twelve (12) gauge hull 24DI through the application of hot glue 24DF to the squib 24DG, which is attached to the ignition wires 24DC. The squib 24DG is kept in position within the twelve gauge hull 24DI through the application of hot glue 24DF as illustrated in FIG. 1.

The explosive end 24DB of the explosive means 24D is slid into the firing chamber 24. The firing chamber end cap 24A has a circular outside surface 24AA, is approximately one and one quarter of an inch (1¼") in length, approximately one and one half of an inch (1½") in outside diameter, has standard internal threads which mate to the standard external threads of the cap end 24C of the firing chamber 24, and has a hole 24AB approximately one eighth of an inch (⅛") in diameter drilled through the center of the circular outside surface 24AA. The ignition wires 24DC of the explosive means 24D are inserted through the hole 24AB of the firing chamber end cap 24A and the firing chamber end cap 24A is screwed onto the cap end 24C of the firing chamber 24 thereby enclosing the firing chamber 24. The ignition wires 24DC of the explosive means 24D are connected to the means for detonation (e.g. power source) through perhaps a remote switching means.

The extension leg 26, as illustrated in FIG. 1, has an upper end 26A, and a lower end 26B. The extension leg 26 has an outside diameter of approximately one inch (1"), and is constructed from schedule 80 stainless steel pipe. The length of the extension leg 26 may be varied according to the height of the vehicle trunk to be breached but is approximately eighteen inches (18"). The upper end 26A of the extension leg 26 has external threads and is screwed into the hole at the lower end 22GA of the cylinder pipe collar 22G.

Figure 7A:
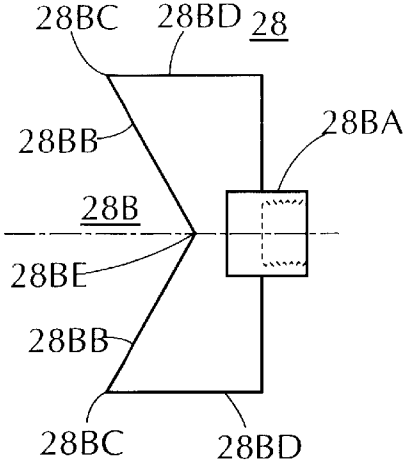
FIG. 7 shows a side and an end view of the foot and foot pipe of the preferred embodiment of the rapid, remote, forcible entry device.
Figure 7C:
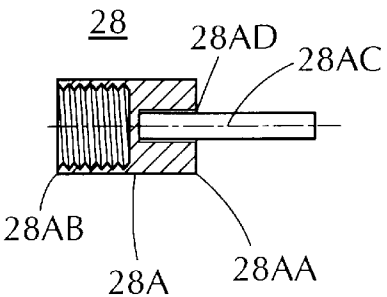
Figure 7B:
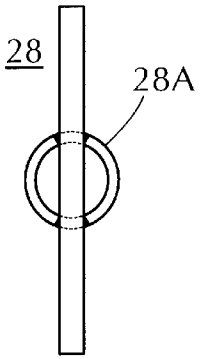

The foot 28, as illustrated in FIG. 7, has been specially designed as a dual position multi terrain platform for the rapid, remote, forcible entry device 10 and has a foot pipe 28A, and a foot plate 28B. The foot pipe 28A has an upper end 28AA, a lower end 28AB, a longitudinal axis 28AC running the length of the foot pipe 28A, an outside diameter of approximately one and one half of an inch (1½"), a length of approximately four and one half of an inch (4½"), and is constructed from schedule 80 stainless steel pipe. The upper end 28AA of the foot pipe 28A has standard internal threads which mate and are screwed into the standard external threads of the lower end 26B of the extension leg 26. The foot plate 28B is stamped from a sheet of stainless steel approximately one quarter of an inch (¼") in thickness with two or more external points 28BC, one or more central points 28BE, central edges 28BB, external edges 28DD, and a tab 28BA. The tab 28BA of the foot plate 28B is welded or otherwise securely attached within the slot 28AD of the foot pipe 28A along the longitudinal axis 28AC. The dimension of the external edge 28BD is approximately four inches (4") while the distance between external edges 28BD is approximately six inches (6").

OPERATION OF THE INVENTION AS A FUNCTIONAL UNIT

Prior to use the operator must compress the piston 20 within the cylinder 22 by depressing the head 12 and piston rod 14 towards the upper end 16B of the piston rod collar 16, as illustrated in FIG. 1. The operator may then select a suitable head 12 for the application and attach the chosen head 12 to the rapid, remote, forcible entry device 10. The operator may also select the extension leg 26 of the correct length for the particular vehicle trunk to be breached such that the rapid, remote, forcible entry device 10 makes approximately a forty five degree angle with the ground when the bottom of the troughlike internal surface 12AB of the catch 12A of the head 12 is engaged along and under the lower edge of the trunk lid of the vehicle to be breached. The operator must then position the head 12 midway along the length trunk lid of the vehicle directly under the locking mechanism of the trunk lid with one of the points 28BC of the foot plate 28B.

The operator must then connect the ignition wires 24DC of the explosive means 24D to the means for detonation. When the operator has safely cleared the area he may then apply power to the ignition wires 24DC of the explosive means 24D by operating the remote switching means.

As the explosive means 24D detonates from the application of the means for detonation the pressure in the area between the cylinder plate 22F and the lower surface 20A of the piston 20 increases thereby forcing the piston 20 to slide towards the upper end 22A of the cylinder 22. The upper surface 20B of the piston 20 is restricted from further movement and is buffered by the action of the piston buffer 18 which serves as a cushion between the upper surface 20B of the piston 20 and the lower surface 16CA of the piston rod collar ring 16C. The action of the piston 20 in sliding towards the upper end 22A of the cylinder 22 forces the piston rod 14 and therefore the head 12 to be driven rapidly upward against the trunk lid of the vehicle thereby breaching the trunk lid or cargo area of the vehicle.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

SUMMARY, RAMIFICATIONS, AND SCOPE OF THE INVENTION

According to the present invention an apparatus for the rapid, remote, forcible entry of a vehicle comprises one or more heads positioned against the vehicle; a piston rod with a head end and a piston end, the head end of the piston rod removably attached to one or more of the heads; a piston rod collar through which the piston rod slides and which acts as a guide for the piston rod; a piston with a lower surface, and an upper surface, attached to the piston end of the piston rod as the piston end of the piston protrudes from the piston rod collar; a cylinder with an external surface, a lower end, an upper end, and a cylinder ring which is attached to the upper end of the cylinder, the piston rod collar being attached to the cylinder ring such that the piston is thereby disposed and restricted to freely slide within the cylinder; a firing chamber with an explosive means mounted on the external surface of the cylinder between the lower end of the cylinder and the piston as the piston is disposed within the cylinder, the firing chamber providing an enclosure for the explosive means; a foot attached to the lower end of the cylinder which permits the apparatus for the rapid, remote, forcible entry of the vehicle to sustain traction on a variety of ground surfaces; and a means for detonation connected to the explosive means of the firing chamber such that when the means for detonation is applied to the explosive means, the explosive means detonates, thereby exerting pressure on the lower surface of the piston and rapidly forcing the piston, the piston rod, and the head towards the trunk lid of the vehicle, thereby breaching the vehicle.

In further accord with the present invention the apparatus for the rapid, remote, forcible entry of the vehicle may comprise a piston buffer disposed around the piston rod located between the piston and the piston rod collar which acts as a buffer between the upper end of the piston and the piston rod collar as the piston completes its upward travel towards the upper end of the cylinder following detonation of the explosive means.

In further accord with the present invention the apparatus for the rapid, remote, forcible entry of the vehicle may comprise an extension leg with an upper end and a lower end, the extension leg being disposed between the lower end of the cylinder and the foot with the upper end of the extension leg being removably attached to the lower end of the cylinder, and the lower end of the extension leg being removably attached to the foot.

In further accord with the present invention the apparatus for the rapid, remote, forcible entry of the vehicle may comprise an extension leg wherein the extension leg is manufactured with various predetermined lengths as interchangeable units to be fitted to the apparatus for the rapid, remote, forcible entry of the vehicle as the particular application demands such that the rapid, remote, forcible entry device makes a predetermined angle with the ground surface.

In further accord with the present invention the apparatus for the rapid, remote, forcible entry of the vehicle may comprise a remote switching means connected to the means for detonation and the explosive means such that the remote switching means provides a safe and effective means of applying and removing power to the explosive means.

In further accord with the present invention the apparatus for the rapid, remote, forcible entry of the vehicle may comprise a piston having an external circumference, a length, one or more grooves cut into the external circumference at various points along the length of the piston, and one or more piston rings inserted into the grooves, the piston rings serving as replaceable elements which reduce the wear of repeated use on the cylinder and the piston as the piston slides within the cylinder.

In further accord with the present invention the apparatus for the rapid, remote, forcible entry of the vehicle may comprise a piston rod collar which contains a bushing disposed within the piston rod collar serving as a replaceable element which reduces the wear of repeated use on the piston rod collar and the piston rod as the piston slides through the piston rod collar.

In further accord with the present invention the apparatus for the rapid, remote, forcible entry of the vehicle may comprise a head which has a pipe coupling, a catch with a troughlike internal surface and an external surface, the pipe coupling being affixed to the external surface of the catch, the troughlike internal surface being of various shapes and dimensions best suited to effectively engage a trunk lid of the vehicle.

In further accord with the present invention the apparatus for the rapid, remote, forcible entry of the vehicle may comprise a head which has a pipe coupling, a catch with a troughlike internal surface and an external surface, the pipe coupling being affixed to the external surface of the catch, the troughlike internal surface being of various shapes and dimensions best suited to effectively cut observation and entry portals into vehicles.

In further accord with the present invention the apparatus for the rapid, remote, forcible entry of the vehicle may comprise a head wherein the catch and the pipe coupling are manufactured with various dimensions, contours, and angles of attachment as interchangeable units to be fitted to the apparatus for the rapid, remote, forcible entry of the trunk lid of the vehicle as the particular application demands.

In further accord with the present invention the apparatus for the rapid, remote, forcible entry of the vehicle may comprise a foot with an upper end, a lower end, a slot, and a longitudinal axis running the length of the foot pipe, the slot cut into the lower end of the foot pipe perpendicular to the longitudinal axis and one or more foot plates with a plurality of external points, a plurality of central points, a plurality of central edges, a plurality of external edges, the foot plate being attached to the foot pipe and of a shape which provides traction with the ground.

In further accord with the present invention the apparatus for the rapid, remote, forcible entry of the vehicle may comprise a foot which is interchangeable with other variations of the foot having different shapes and dimensions best suited for traction on a particular ground surface.

In further accord with the present invention a method for the rapid, remote, forcible entry of the vehicle may comprise the steps of compressing a piston within a cylinder, the cylinder having an upper end, a lower end, and a firing chamber, the piston being attached to a head external to the cylinder via a piston rod; engaging the head under a trunk lid of the vehicle; setting a foot attached to the cylinder onto a ground surface such that the cylinder is fixed with respect to the vehicle; inserting an explosive means into the firing chamber which is affixed to the cylinder; and detonating via a means for detonation connected to the explosive means, thereby increasing pressure in the cylinder, thereby forcing the piston, the piston rod, and the head rapidly towards the trunk lid of the vehicle thereby breaching the trunk lid of the vehicle.

In further accord with the present invention the method for the rapid, remote, forcible entry of the vehicle may comprise the step of applying the means for detonation via remote switching means connected to the means for detonation and the explosive means.

In further accord with the present invention the method for the rapid, remote, forcible entry of the vehicle may comprise the step of selecting the head from various interchangeable heads having predetermined dimensions and contours whereby the contours of the head mirror those of the vehicle to be breached and cutting observation and entry portals into vehicles.

In further accord with the present invention the method for the rapid, remote, forcible entry of the vehicle may comprise the steps of selecting an extension leg with dimensions such that the apparatus for the rapid, remote, forcible entry of the vehicle will be positioned at a predetermined angle with respect to the ground surface when the head is engaged beneath the vehicle to be breached; and attaching the extension leg between the cylinder and the foot thereby controlling the direction of the force exerted by the head against the vehicle to be breached, thereby optimizing the efficiency of the apparatus for the rapid, remote, forcible entry of the vehicle in breaching the vehicle.

In further accord with the present invention the method for the rapid, remote, forcible entry of the vehicle may comprise the step of selecting the explosive means from various interchangeable alternatives having different explosive characteristics within a predetermined safety tolerance thereby optimizing the ability of the apparatus for the rapid, remote, forcible entry of the vehicle to safely and effectively breach the trunk lid of the vehicle.

In further accord with the present invention the method for the rapid, remote, forcible entry of the vehicle may comprise the step of selecting the foot from various interchangeable alternatives having predetermined dimensions and contours thereby optimizing the traction of the foot and, therefore, the apparatus for the rapid, remote, forcible entry of the vehicle with respect to the ground surface.

The invention presented herein employs a controlled explosion within an extremely confined area and, therefore, there is little if any danger due to fire. Furthermore, the subject invention may be constructed from relatively inexpensive and readily available materials which may be used almost indefinitely with minimal maintenance.

As is apparent from the above detailed description the subject invention may be remotely operated from a safe distance in order to grant the greatest degree of safety to the user, particularly in an emergency situation where the user may not be concentrating solely on the operation of the tool.

Since the force generated by the subject invention is applied to only a very limited area surrounding the latching mechanism of the trunk lid of the vehicle potential damage to the contents of the trunk as well as the integrity of the body of the vehicle is thereby kept to an absolute minimum. The subject invention can also cut observation/entry portals into the sides of trucks and vans in order to observe the interior of the vehicle (which may contain explosives) without damaging the integrity of the vehicle.

Due to the limited number of moving parts contained in the subject invention susceptibility to damage or jamming caused by dirt, dust, moisture or other particles found in the environment is relatively nonexistent.

The unique design of the subject invention sets it apart from the prior art as the only design which is effective in breaching the trunk of a vehicle.

Through the use of explosives the means used by the subject invention to generate force is smaller, lighter, cheaper per application, safer, more adjustable to different applications, and potentially more powerful than those inventions in the prior art which utilize compressed gas.

Due to the interchangeability of the head, foot, and extension leg of the subject invention this tool is readily adaptable to the wide variety of vehicle contours in existence whether envisioned by a manufacturer of the tool at the time the tool is initially produced or not.

While the present invention has been described in conjunction with specific embodiments thereof, it is evident that many alternatives, modifications, and variations will be apparent to those skilled in the art in light of the foregoing description including but not limited to the following:

(a) the use of the rapid, remote, forcible entry device in combination with a robotic device;

(b) the use of the rapid, remote, forcible entry device to forcibly open doors where there is a threat to the safety of law enforcement agents;

(c) the use of interchangeable variations of the head differing in the following parameters which are intended for illustrative purposes only and not as an exhaustive enumeration of possibilities:
  (i) angle and position of attachment of the pipe coupling to the external surface of the catch;
  (ii) shape and dimensions of the catch;
  (iii) number of heads attached to each pipe coupling;
  (iv) method of attachment of the head to the piston rod;
  (v) fabrication or integration of the catch and pipe coupling as one unit; and
  (vi) material used in construction of the catch and pipe coupling.

(d) the piston rod, piston rod collar, piston buffer, piston, cylinder, extension leg, and handle are likewise suited to modification without changing the substance of the invention in the following ways:
  (i) length, diameter, and overall dimensions keeping in mind the stresses placed upon the foregoing elements during operation;
  (ii) method of attachment between and among the foregoing elements;
  (iii) fabrication or integration of the foregoing elements into fewer elements;
  (iv) division of the foregoing elements into a greater number of separate elements;
  (v) addition of internal grooves or guides to prevent the head from rotating with respect to the cylinder during operation; and
  (vi) materials used in constructing the foregoing elements.

(e) the explosive means is subject to the following modifications without changing the substance of the invention:
  (i) amount and composition of the ignitable substance contained within the explosive means keeping in mind the stresses placed upon the invention during operation;
  (ii) length, diameter, and overall dimensions;
  (iii) method of ignition; and
  (iv) number of ignition wires.

(f) the foot is subject to the following modifications without changing the substance of the invention:
  (i) overall dimensions keeping in mind the stresses placed upon the foot during operation;
  (ii) method of attachment between and among the foot and the remaining elements of the invention;
  (iii) fabrication or integration of the elements of the foot into fewer elements;
  (iv) division of the elements of the foot into a greater number of separate elements;
  (v) shape of the left and right foot plates keeping in mind the primary purpose of providing a stable platform for the use of the rapid, remote, forcible entry device on a variety of ground surfaces; and
  (vi) materials used in constructing the elements of the foot.

Accordingly, the present invention is intended to embrace and claim all such alternatives, modifications, and variations as falling within the spirit and broad scope of the invention and claims.

For a better understanding of the invention, reference is made to the accompanying drawings. Accordingly, the scope of the invention should be determined not by the embodiments described and illustrated herein, but by the appended claims and their legal equivalents.

Having set forth the general nature and specific embodiments of the present invention, the true scope is now particularly pointed out in the appended claims.

What is claimed is:

1. An apparatus for forcible entry of a vehicle, which comprises:

a substantially concave head which engages a lower edge of a trunk lid of said vehicle;

a piston rod comprising a head end and a piston end, said head end attached to said head;

a piston comprising a lower surface, and an upper surface, said upper surface attached to said piston end of said piston rod;

a cylinder comprising an external surface, a lower end and an upper end, said piston disposed within and restricted to freely slide within said cylinder;

means for stabilization attached to said lower end of said cylinder comprising points which sustain traction on a ground surface; and means for remotely forcing said piston, said piston rod and said head rapidly towards said trunk lid such that said trunk lid is forcibly breached, said head and said means for stabilization positioned along a substantially linear path between said ground surface and said trunk lid.

2. The apparatus for forcible entry of a vehicle of claim 1, wherein said cylinder further comprises a piston buffer disposed around said piston rod and between said upper surface of said piston and said upper end of said cylinder, said piston buffer functioning as a cushion between said upper surface and said upper end.

3. The apparatus for forcible entry of a vehicle of claim 1, wherein said means for stabilization further comprises an extension leg and a foot, said extension leg comprising an upper end and a lower end, said extension leg being disposed between said lower end of said cylinder and said foot, said upper end of said extension leg being attached to said lower end of said cylinder, and said lower end of said extension leg being attached to said foot.

4. The apparatus for forcible entry of a vehicle of claim 3, wherein said extension leg is removably attached to said lower end of said cylinder, said extension leg comprising a predetermined length which when attached to said lower end permits said apparatus to make a predetermined angle with respect to said ground surface.

5. The apparatus for forcible entry of a vehicle of claim 1, wherein said stabilization means further comprises a foot, said foot being attached to said lower end of said cylinder.

6. The apparatus for forcible entry of a vehicle of claim 1, wherein said means for remotely forcing said piston, said piston rod and said head towards said trunk lid further comprises a firing chamber in which means for explosion is disposed, said means for explosion rapidly increasing pressure on said piston upon detonation, thereby forcing said piston, said piston rod and said head towards said trunk lid.

7. The apparatus for forcible entry of a vehicle of claim 6, wherein said means for explosion further comprises ignition wires for remote activation of said means for explosion.

8. The apparatus for forcible entry of a vehicle of claim 6, wherein said means for explosion further comprises a modified shotgun shell.

9. The apparatus for forcible entry of a vehicle of claim 1, wherein said piston further comprises an external circumference, a length, a groove disposed annularly around said external circumference at a predetermined location on said piston, and a piston ring inserted into said groove.

10. The apparatus for forcible entry of a vehicle of claim 1, wherein said cylinder further comprises a piston rod collar located at said upper end of said cylinder and a bushing disposed within said piston rod collar, said piston rod sliding freely within said bushing.

11. The apparatus for forcible entry of a vehicle of claim 1, wherein said head further comprises a coupling and a catch, said catch comprising a substantially concave internal surface and an external surface, said coupling being affixed to said external surface of said catch, said substantially concave internal surface comprising a predetermined shape and dimensions in order to engage said trunk lid of said vehicle.

12. The apparatus for forcible entry of a vehicle of claim 1, wherein said head further comprises a coupling and a catch, said catch comprising means for cutting and an external surface, said coupling being affixed to said external surface of said catch, said means for cutting comprising a predetermined shape and dimensions in order to cut portals into said vehicle.

13. The apparatus for forcible entry of a vehicle of claim 1, wherein said head is removably attached to said piston rod.

14. The apparatus for forcible entry of a vehicle of claim 1, wherein said means for stabilization further comprises a foot plate comprising a plurality of external points which maintain traction on said ground surface.

15. The apparatus for forcible entry of a vehicle of claim 1, wherein said means for stabilization is removably attached to said cylinder.

* * * * *